US009195166B2

(12) United States Patent
Tsuda et al.

(10) Patent No.: US 9,195,166 B2
(45) Date of Patent: Nov. 24, 2015

(54) DEVELOPER STORAGE CONTAINER HAVING IMPROVED WORKABILITY WITH MOUNTED DEVELOPER AGITATION MEMBER AND MANUFACTURING METHOD THEREOF

(71) Applicant: CANON KABUSHIKI KAISHA, Tokyo (JP)

(72) Inventors: Satoshi Tsuda, Mishima (JP); Takahito Ueno, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 1 day.

(21) Appl. No.: 13/943,612

(22) Filed: Jul. 16, 2013

(65) Prior Publication Data

US 2014/0023402 A1 Jan. 23, 2014

(30) Foreign Application Priority Data

Jul. 18, 2012 (JP) ..... 2012-159515

(51) Int. Cl.
*G03G 15/08* (2006.01)
*G03G 21/18* (2006.01)

(52) U.S. Cl.
CPC ..... *G03G 15/0822* (2013.01); *G03G 15/0877* (2013.01); *G03G 21/181* (2013.01)

(58) Field of Classification Search
CPC ..... G03G 21/181; G03G 2215/0855; G03G 2221/1876
USPC ..... 399/109, 254
See application file for complete search history.

(56) References Cited

U.S. PATENT DOCUMENTS 5,710,961 A * 1/1998 Jeong
6,188,856 B1 * 2/2001 Sato
6,246,854 B1 * 6/2001 Kurosawa et al.
2006/0291910 A1 * 12/2006 Choi et al.
2009/0022512 A1 * 1/2009 Noh et al.

FOREIGN PATENT DOCUMENTS

JP 2011-158588 A 8/2011

* cited by examiner

*Primary Examiner* — Walter L Lindsay, Jr.
*Assistant Examiner* — Milton Gonzalez
(74) *Attorney, Agent, or Firm* — Canon U.S.A., Inc. IP Division

(57) ABSTRACT

In order to achieve an improvement in terms of workability when mounting a developer agitation member and a drive transmission member to a container portion storing developer, there is provided a method of mounting a developer storage container in which, when mounting a developer agitation member to a developer storage portion, a drive transmission member is inserted for connection from an end portion of the developer agitation member, the developer agitation member exhibits a first phase and a second phase. The first phase allows connection of the developer agitation member and the drive transmission member in the insertion path of the drive transmission member, whereas the second phase does not allow connection of the developer agitation member and the drive transmission member in the insertion path of a support member.

19 Claims, 14 Drawing Sheets

DEVELOPER STORAGE CONTAINER HAVING IMPROVED WORKABILITY WITH MOUNTED DEVELOPER AGITATION MEMBER AND MANUFACTURING METHOD THEREOF

BACKGROUND OF THE INVENTION

1. Field of the Invention

The present invention relates to a developer storage container storing developer for electrophotographic image formation and a method of manufacturing the same.

Here, the developer storage container is a container storing developer for use in an electrophotographic image forming apparatus. It includes, for example, a process cartridge, a developer replenishment cartridge portion, which can be detachably attached to an electrophotographic image forming apparatus main body.

The electrophotographic image forming apparatus (hereinafter, referred to as the "image forming apparatus") is one configured to form an image on a recording medium by using the electrophotographic image formation process. Examples of the image forming apparatus include an electrophotographic copying machine, an electrophotographic printer such as an LED printer or a laser beam printer, an electrophotographic facsimile apparatus, and an electrophotographic word processor.

The recording medium is a substance on which image is to be formed. Examples of the recording medium include a recording sheet and an overhead-projector (OHP) sheet.

2. Description of the Related Art

Conventionally, a process cartridge system has been known in which an electrophotographic photosensitive member and a process unit acting thereon are integrated into a cartridge together with developer as a developer storage container. The process cartridge can be attached to an image forming apparatus main body, and detached therefrom. In the process cartridge system, the maintenance of the apparatus can be performed by the user, so that it is possible to achieve an improvement in terms of operability.

The process cartridge is formed by a cleaning device (hereinafter, referred to as a cleaning unit) and a developing device (hereinafter, referred to as a developing unit). The cleaning unit has an image bearing member as the electrophotographic photosensitive member, a cleaning member for cleaning the surface of the image bearing member, etc. The developing unit has a developing roller configured to supply developer to the image bearing member, a developer storage portion for storing the developer, etc.

On the other hand, as an example of the process cartridge system, a developer replenishment system is known. In this system, a developer replenishment opening of a developer replenishment cartridge and a developer reception port of the process cartridge are connected to each other, making it possible to replenish the process cartridge with developer from the developer replenishment cartridge.

In the developer replenishment system, if new developer replenished from the developer replenishment cartridge and old developer in the developing unit are mixed with each other in an uneven state, this will result in a defective image. Therefore, the following construction is adopted for the developer replenishment type process cartridge.

The developing unit is divided into a developing portion and a developer storage portion. The developing portion and the developer storage portion are connected to each other via openings provided at both ends in the rotation axis direction of the image bearing member (hereinafter, referred to as a "longitudinal direction"). The developing portion and the developer storage portion are respectively provided with a developer conveyance member for conveying developer and a developer agitation member.

The developer conveyance member and the developer agitation member receive rotational drive from the outside via a drive transmission member, and conveys the developer in the longitudinal direction of the developer conveyance member and of the developer agitation member. By thus agitation-circulating the developer within the developing unit, new developer and old developer are uniformly mixed with each other.

The following method is known as a method of assembling this developer agitation member.

According to Japanese Patent Application Laid-Open No. 2011-158588, one end in the axial direction of the developer agitation member is retained in the vicinity of a through-hole provided in a container portion storing developer, with the one end thereof being raised, and the other end thereof is supported by an agitation member supporting portion formed on a side wall of the container portion, with a drive member being inserted via the through-hole.

However, in the method discussed in Japanese Patent Application Laid-Open 2011-158588, it is necessary to mount a drive transmission member to the developer agitation member while retaining one end of the developer agitation member in a state of being raised in the container portion storing the developer, which involves a problem in terms of workability for the assembly worker. Also in a case where the assembly is performed by an assembly robot, it is necessary for the robot to perform a similar retaining control. As a result, a complicated robot is needed.

SUMMARY OF THE INVENTION

The present invention is directed to a developer storage container capable of improving workability when mounting a developer agitation member and a drive transmission member to a container portion storing developer.

According to an aspect of the present invention, a developer storage container includes a container portion configured to store developer, an agitation member provided inside the container portion and configured to agitate the developer through rotation, and a transmission member connected to the agitation member via a through-hole provided in the container portion and configured to transmit a drive force for rotation to the agitation member, wherein the agitation member has a first contact portion configured to be held in contact with the container portion when the agitation member not connected with the transmission member is placed inside the container portion in a first phase in the rotational direction of the agitation member, and allow connection between the agitation member and the transmission member via the through-hole when the first contact portion is held in contact with the container portion, and wherein a second contact portion configured to be held in contact with the container portion when the agitation member not connected with the transmission member is placed inside the container portion in a second phase in the rotational direction of the agitation member, and not allow connection between the agitation member and the transmission member via the through-hole when the second contact portion is held in contact with the container portion.

According to another aspect of the present invention, a method of manufacturing a developer storage container including a container portion configured to store developer, an agitation member provided inside the container portion and configured to agitate the developer through rotation, and a transmission member connected to the agitation member via a through-hole provided in the container portion and configured to transmit a drive force for rotation to the agitation member, wherein the agitation member has a first contact portion configured to be held in contact with the container portion when the agitation member not connected with the transmission member is placed inside the container portion in a first phase in the rotational direction of the agitation member, and allow connection between the agitation member and the transmission member via the through-hole when the first contact portion is held in contact with the container portion, and wherein a second contact portion configured to be held in contact with the container portion when the agitation member not connected with the transmission member is placed inside the container portion in a second phase in the rotational direction of the agitation member, and not allow connection between the agitation member and the transmission member via the through-hole when the second contact portion is held in contact with the container portion, includes placing the agitation member not connected with the transmission member inside the container portion in the first phase in the rotational direction of the agitation member, and connecting the agitation member and the transmission member via the through-hole when the first contact portion is held in contact with the container portion.

Further features of the present invention will become apparent from the following detailed description of exemplary embodiments with reference to the attached drawings.

DESCRIPTION OF THE EMBODIMENTS

A color image forming apparatus using a process cartridge and a developer replenishment cartridge according to the present invention will be described below with reference to the drawings.

<Overall Construction of Image Forming Apparatus>

Figure 2:
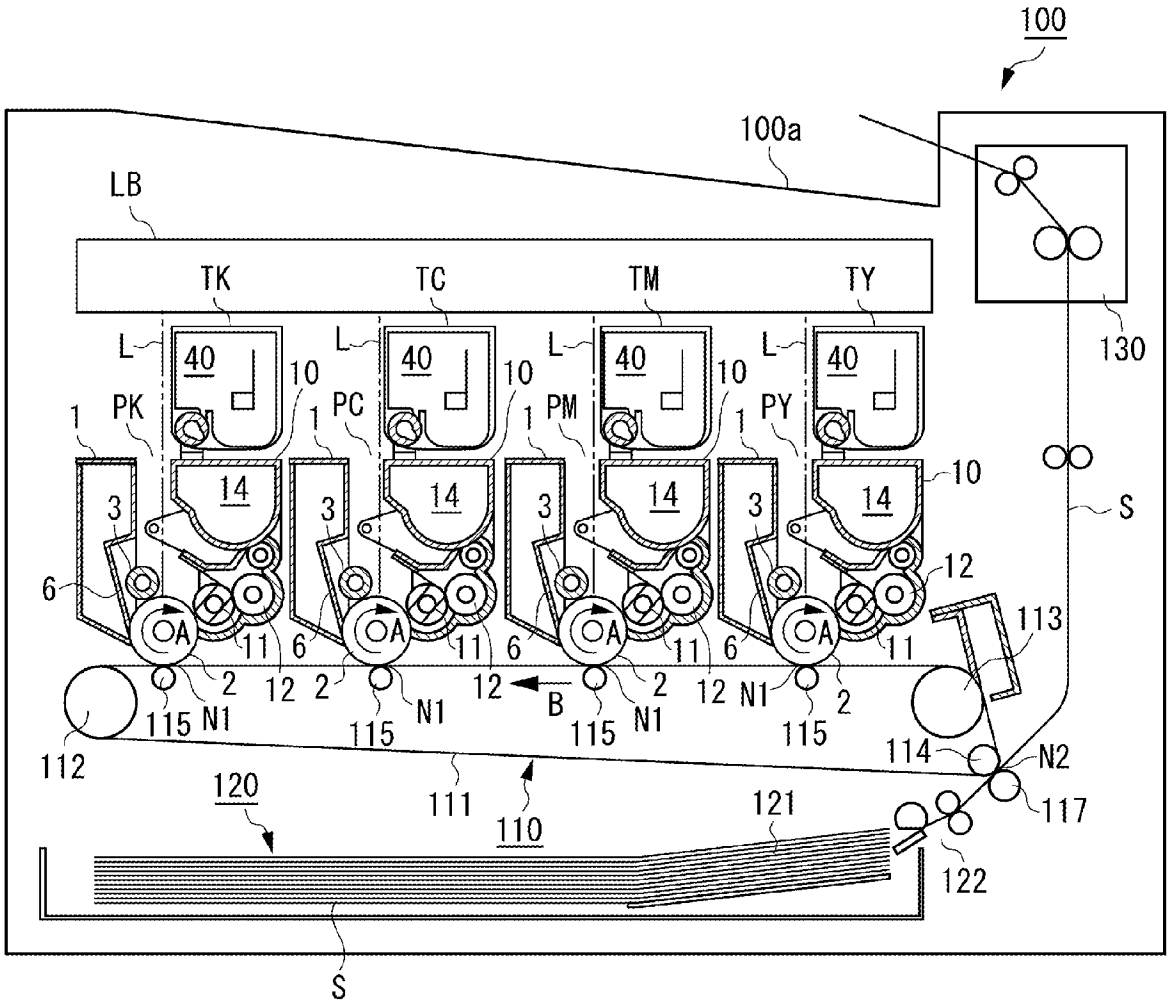
FIG. 2 is a schematic sectional view of an electrophotographic image forming apparatus according to the first exemplary embodiment and a second exemplary embodiment of the present invention.
Figure 3:
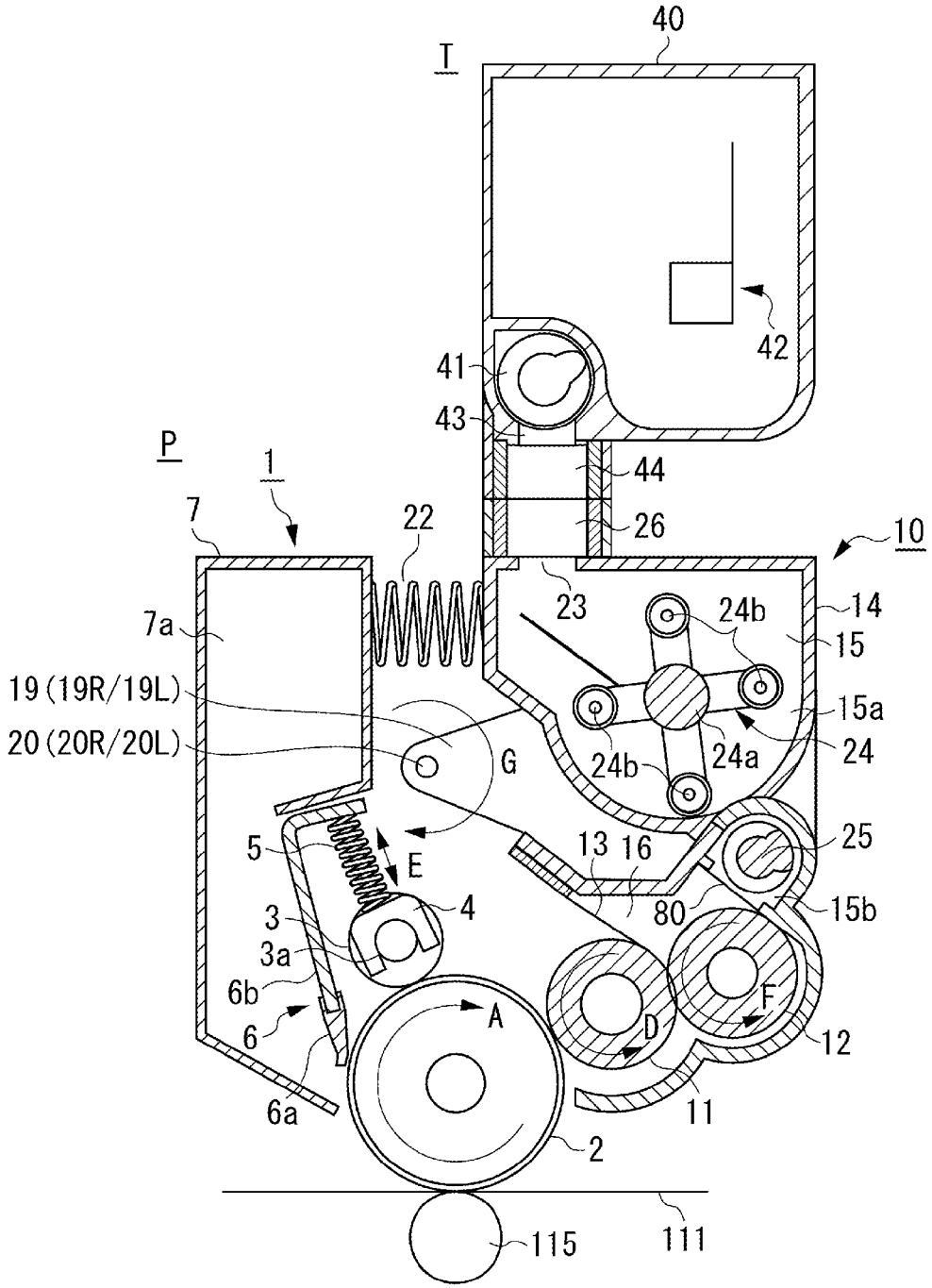
FIG. 3 is a main sectional view of a process cartridge and a developer replenishment cartridge according to the first exemplary embodiment and the second exemplary embodiment of the present invention.

First, the overall construction of the image forming apparatus (hereinafter, referred to as an "apparatus main body") 100 will be described with reference to FIGS. 2 and 3. FIG. 2 is a schematic sectional view of the color electrophotographic image forming apparatus. FIG. 3 is a main portion sectional view of the process cartridge and of the developer replenishment cartridge.

The apparatus main body 100 illustrated in FIG. 2 is a full four-color laser printer employing the electrophotographic process and configured to form a color image on a recording medium S. The apparatus main body 100 adopts a process cartridge system. In this system, a process cartridge P and a developer replenishment cartridge T are detachably attached to the apparatus main body 100, and a color image is formed on the recording medium S.

In the following description, the image forming apparatus as referred to in this specification means the apparatus component as obtained by removing the process cartridge P and the developer replenishment cartridge T from the apparatus main body.

In the apparatus main body 100, first through fourth process cartridges P (PY, PM, PC, and PK), and first through fourth developer replenishment cartridges T (TY, TM, TC, and TK) are arranged horizontally side by side. The process cartridges P and the developer replenishment cartridges T have a similar electrophotographic process mechanism, and they differ from each other in developer color and developer filling amount.

A rotational drive force is transmitted from the apparatus main body 100 to the process cartridges P and to the developer replenishment cartridges T. Further, a bias (a charging bias, developing bias, etc.) is supplied from the apparatus main body 100 to the process cartridges P. The process cartridges P and the developer replenishment cartridges T are individually detachably attachable to the apparatus main body 100.

As illustrated in FIG. 3, each process cartridge P according to the present exemplary embodiment is formed by a cleaning unit 1 and a developing unit 10. The cleaning unit 1 is equipped with a photosensitive drum 2 serving as an image bearing member, a charging roller 3 configured to act on this photosensitive drum 2, and a cleaning member 6.

The developing unit 10 has a development means for developing an electrostatic latent image on the photosensitive drum 2. The cleaning unit 1 and the developing unit 10 are connected with each other to be swingable with respect to each other.

The first process cartridge PY stores yellow (Y) developer in a developer storage portion 15, and is configured to form a yellow developer image on the photosensitive drum 2. Similarly, the second process cartridge PM stores magenta (M) developer, the third process cartridge PC stores cyan (C) developer, and the fourth process cartridge PK stores black (K) developer.

On the other hand, the first developer replenishment cartridge TY stores yellow (Y) developer in a replenishment frame member 40, and replenishes the process cartridge PY storing developer of the same color with yellow developer. Similarly, the second developer replenishment cartridge TM stores magenta (M) developer, and replenishes the process cartridge PM storing developer of the same color with magenta developer.

Similarly, the third developer replenishment cartridge TC stores cyan (C) developer, and replenishes the process cartridge PC storing developer of the same color with cyan developer. Similarly, the fourth developer replenishment cartridge TK stores black (K) developer, and replenishes the process cartridge PK storing developer of the same color with black developer.

As illustrated in FIG. 3, the replenishment frame member 40 of the replenishment cartridge T is provided with a developer replenishment opening 43 for replenishing the process cartridge P with developer. The developer storage portion 15 of the process cartridge P is provided with a developer reception port 23 corresponding to the developer replenishment opening 43.

When the process cartridge P and the developer replenishment cartridge T are attached to the apparatus main body 100, communication is established between the developer replenishment opening 43 and the developer reception port 23, and developer is replenished from the developer replenishment cartridge T to the process cartridge P.

The process cartridge P and the developer replenishment cartridge T will be described in detail below.

As illustrated in FIG. 2, a laser scanner unit LB as an exposure unit is arranged above the process cartridges P (PY, PM, PC, and PK). The laser scanner unit LB outputs laser light L in correspondence with image information. Scanning exposure is performed on the surface of the photosensitive drum 2 with the laser light L.

An intermediate transfer belt unit 110 as a primary transfer member is arranged under the process cartridges P (PY, PM, PC, and PK). The intermediate transfer belt unit 110 has an endless transfer belt 111 having flexibility, a driving roller 112, a driven roller 113, and a secondary transfer opposing roller 114 for rotating the transfer belt 111 that is stretched therearound.

The photosensitive drums 2 of the process cartridges P are in contact with the transfer belt 111. Contact portions N1 between the photosensitive drums 2 and the transfer belt 111 constitute primary transfer portions. Primary transfer rollers 115 are arranged on the inner side of the transfer belt 111 opposing the photosensitive drums 2.

A secondary transfer roller 117 as a secondary transfer unit is arranged at a position opposing the secondary transfer opposing roller 114. The contact portion N2 between the transfer belt 111 and the secondary transfer roller 117 constitute the secondary transfer portion.

A feeding unit 120 is arranged below the intermediate transfer belt unit 110. The feeding unit 120 has a feeding tray 121 storing recording mediums S, and a feed-out roller 122.

A fixing unit 130 is arranged in the upper portion of the interior of the apparatus main body 100. The upper surface of the apparatus main body 100 constitutes a discharge tray 100*a*.

<Image Forming Operation>

Next, a full-color image forming operation will be described with reference to FIG. 2. FIG. 2 is a schematic sectional view of the color electrophotographic image forming apparatus.

The full-color image forming operation is as follows.

The photosensitive drums 2 of the first through fourth cartridges P (PY, PM, PC, and PK) are rotated at a predetermined speed in the direction of the arrow A in FIG. 2. The transfer belt 111 is rotated in the direction of the arrow B (in the forward direction with respect to the rotation of the photosensitive drums). At this time, the speed of the transfer belt 111 corresponds to the speed of the photosensitive drums 2. At the same time, the laser scanner unit LB is driven.

The charging rollers 3 of the cartridges P uniformly charge the surfaces of the photosensitive drums 2 to a predetermined polarity and potential in synchronization with the driving of the laser scanner unit LB. The laser scanner unit LB performs scanning exposure on the surfaces of the photosensitive drums 2 with laser light L corresponding to image signals of the difference colors. As a result, electrostatic latent images corresponding to the image signals of the corresponding colors are respectively formed on the surfaces of the photosensitive drums 2. The formed electrostatic latent images are developed by the developing rollers 11 as developer carrying members for carrying developers.

Through the above image forming operation, a yellow developer image is formed on the photosensitive drum 2 of the first cartridge PY. And, the yellow developer image is primarily transferred onto the transfer belt 111.

Similarly, the developer images of the second cartridge PM, the third cartridge PC, and the fourth cartridge PK are superimposed one upon the other on the transfer belt 111, whereby a four-color unfixed developer image is formed. In each of the process cartridges P, developer remaining on the surface of the photosensitive drum 2 after the primary transfer is removed by the cleaning member 6.

On the other hand, a recording medium S stored on the feeding tray 121 is fed with a predetermined control timing. The four-full-color developer image on the transfer belt 111 is collectively transferred to the surface of the recording medium S introduced into the secondary transfer portion N2.

The recording medium S is separated from the surface of the transfer belt 111 and is introduced into the fixing unit 130. Then, it undergoes heating and pressurization at a fixing nip portion. As a result, the developer image is fixed on the recording medium S. Thereafter, the recording medium S that has undergone fixing is conveyed to the discharge tray 100*a*, whereby the full-color image forming operation is completed.

<Overall Construction of the Process Cartridge>

Figure 4:
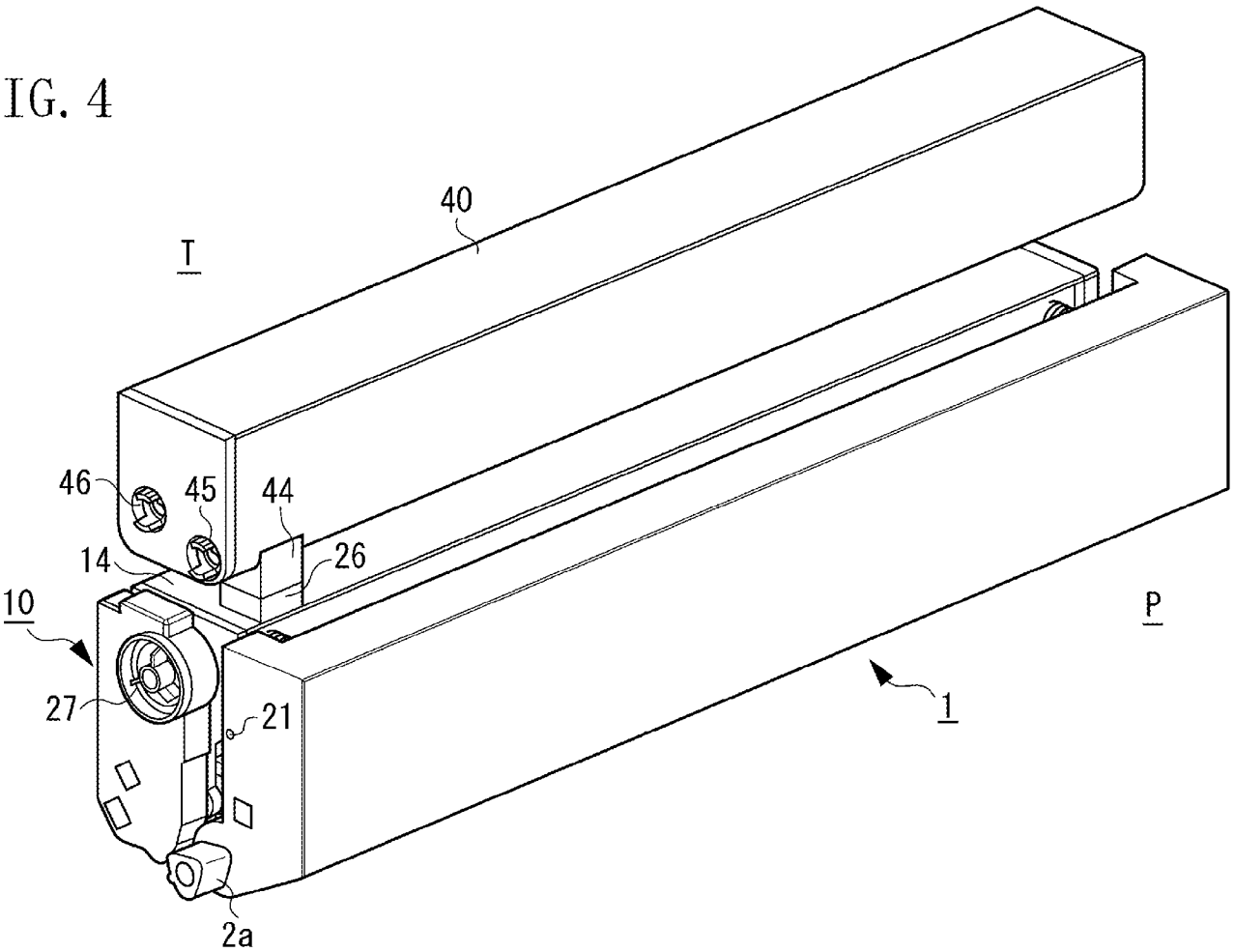
FIG. 4 is an overall perspective view of the process cartridge and the developer replenishment cartridge in the image forming apparatus according to the first exemplary embodiment and the second exemplary embodiment of the present invention.

Next, the overall construction of the process cartridge P will be described with reference to FIGS. 3, 4, and 5.

FIG. 3 is a main portion sectional view of the process cartridge and of the developer replenishment cartridge. FIG. 4 is an overall perspective view of the process cartridge P and of the developer replenishment cartridge T in the image forming apparatus. FIG. 5 is an exploded perspective view illustrating the overall construction of the process cartridge P.

As illustrated in FIG. 3, the process cartridge P (PY, PM, PC, PK) is formed by the cleaning unit 1 and the developing unit 10.

First, the cleaning unit 1 will be described. The cleaning unit 1 has, in a cleaning frame member 7, the photosensitive drum 2, the charging roller 3, and the cleaning member 6.

The photosensitive drum 2 is rotatably supported by the cleaning frame member 7. As illustrated in FIG. 4, a drum drive coupling 2*a* is provided at one end of the photosensitive drum 2. The photosensitive drum 2 and the drum drive coupling 2*a* are formed integrally.

The drum drive coupling 2*a* is engaged with a coupling (not illustrated) of the apparatus main body 100. The drive force of a drive motor (not illustrated) of the apparatus main body 100 is transmitted to the drum drive coupling 2*a*, whereby the photosensitive drum 2 is rotated at a predetermined speed in the direction of the arrow A in FIG. 3.

The charging roller 3 is driven to rotate while being held in contact with the photosensitive drum 2. As illustrated in FIG. 3, the charging roller 3 is mounted to the cleaning frame member 7 via a charging roller bearing 4. The charging roller 3 is mounted to be movable in the direction of the arrow E in FIG. 3 along a line connecting the rotation center of the charging roller 3 and the rotation center of the photosensitive drum 2.

A rotation shaft 3*a* of the charging roller 3 is rotatably supported by the charging roller bearing 4. The charging roller bearing 4 is urged toward the photosensitive drum 2 by a charging roller pressing member 5.

The cleaning member 6 is composed of an elastic rubber blade 6*a* at the distal end thereof and a support metal plate 6*b*. The distal end of the elastic rubber blade 6*a* is held in contact with the photosensitive drum 2 in a counter direction to the rotational direction of the photosensitive drum 2 (the direction of the arrow A in FIG. 3). The cleaning member 6 removes developer remaining on the photosensitive drum 2. The developer removed from the peripheral surface of the photosensitive drum 2 by the cleaning member 6 is stored in a removed developer storage portion 7*a* of the cleaning frame member 7.

Next, the developing unit 10 will be described. As illustrated in FIG. 3, the developing unit 10 has a development frame member 14 supporting various elements in the developing unit 10. The development frame member 14 is divided into a developing portion 16 and a developer storage portion 15.

The developing portion 16 is provided with a developing roller 11, a developer supply roller (hereinafter, referred to as a "supply roller") 12, and a development blade 13. The developing roller 11 is configured to rotate in the direction of the arrow D while being in contact with the photosensitive drum 2.

The supply roller 12 is configured to rotate in the direction of the arrow F while being in contact with the developing roller 11. The supply roller 12 has two functions. One is to supply developer onto the developing roller 11. The other is to scrape off the developer remaining on the developing roller 11 without having been supplied for development. The development blade 13 is configured to come into contact with the peripheral surface of the developing roller 11, thereby regulating the thickness of the developer layer on the developing roller 11.

On the other hand, the developer storage portion 15 stores the developer supplied from the developer replenishment cartridge T. The developer storage portion 15 will be described in detail below.

Next, the connection between the cleaning unit 1 and the developing unit 10 will be described.

Figure 5:
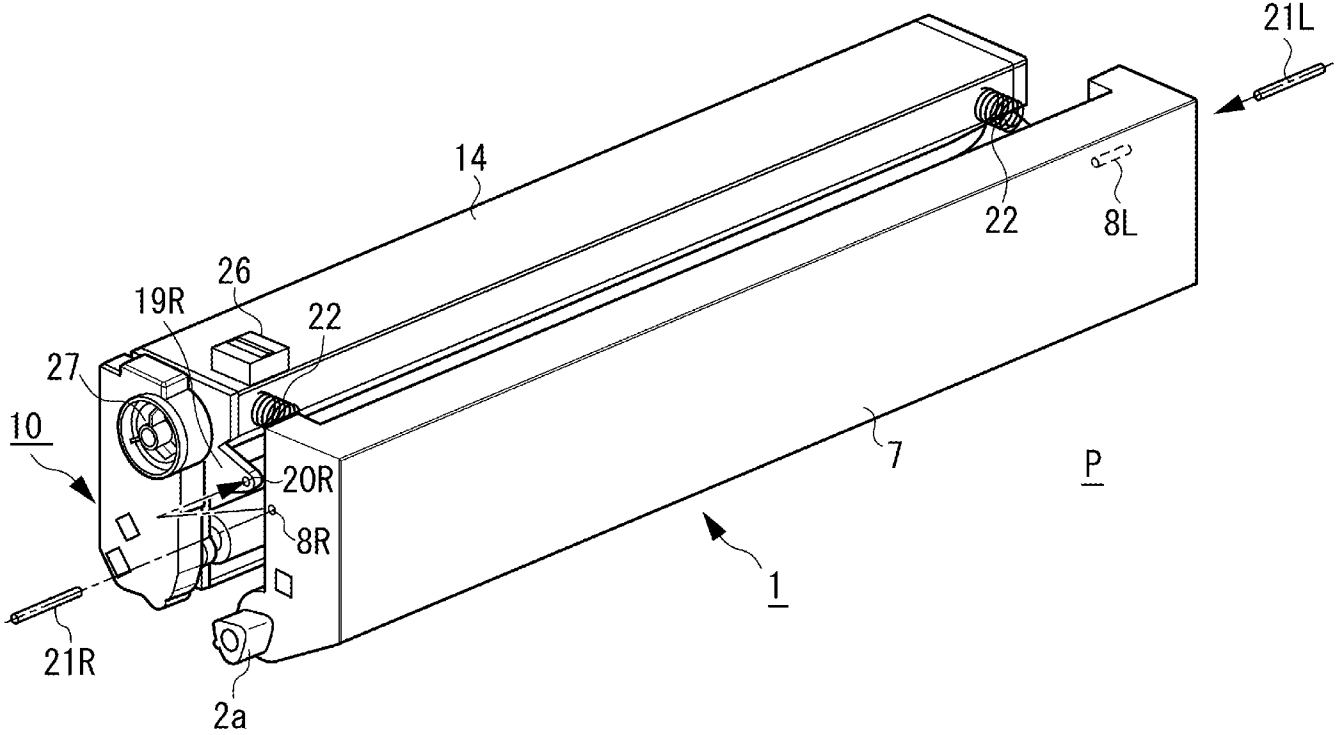
FIG. 5 is an overall exploded perspective view of the process cartridge according to the first exemplary embodiment and the second exemplary embodiment of the present invention.

As illustrated in FIG. 5, the cleaning frame member 7 has cleaning connection holes 8 (8R and 8L). As illustrated in FIG. 3, the developing frame member 14 is provided with development side plates 19 (19R and 19L) at both ends in the longitudinal direction. The development side plates 19 (19R and 19L) have development connection holes 20 (20R and 20L).

As illustrated in FIG. 5, the cleaning connection holes 8 (8R and 8L) and the development connection holes 20 (20R and 20L) are fit-engaged with connection shafts 21 (21R and 21L) to be thereby swingably connected therewith. As a result, the cleaning unit 1 and the developing unit 10 are connected with each other.

As illustrated in FIG. 5, pressure springs 22 are arranged between the cleaning unit 1 and the developing unit 10 at both sides thereof. Due to the urging force of the pressure springs 22, the developing unit 10 obtains a rotational moment in the direction of the arrow G in FIG. 3 around the development connection holes 20. As a result, the developing roller 11 comes into contact with the photosensitive drum 2.

Although the developing roller 11 is arranged so as to be in contact with the photosensitive drum 2, it is also possible for the developing roller to be arranged at a predetermined interval from the photosensitive drum.

<Overall Construction of the Developer Replenishment Cartridge>

Figure 6:
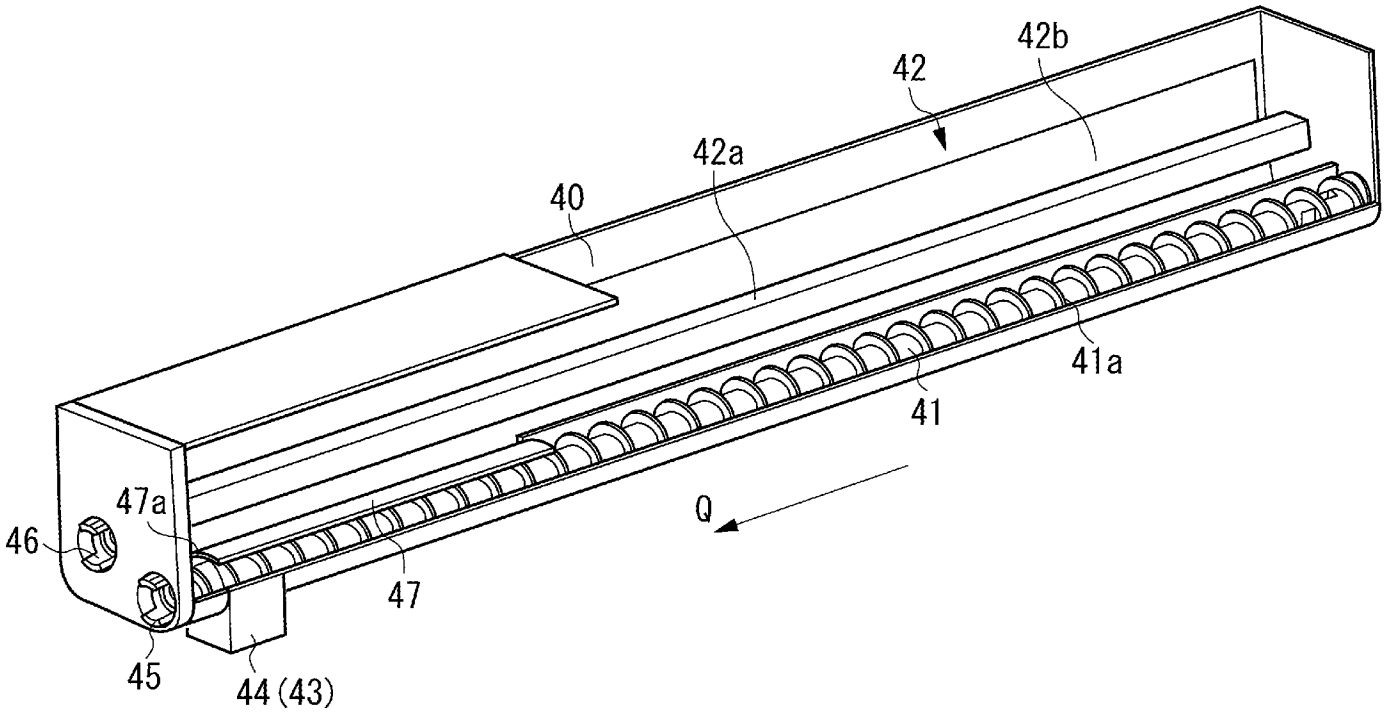
FIG. 6 is a schematic perspective view illustrating the construction of the developer replenishment cartridge according to the first exemplary embodiment and the second exemplary embodiment.

Next, the construction of the developer replenishment cartridge T will be described with reference to FIGS. 3 and 6. FIG. 3 is a main portion sectional view of the process cartridge P and of the developer replenishment cartridge T. FIG. 6 is a schematic perspective view illustrating the construction of the developer replenishment cartridge T.

As illustrated in FIG. 3, the developer replenishment cartridge T has the replenishment frame member 40 for storing developer. The replenishment frame member 40 has the developer replenishment opening 43 for replenishing the process cartridge P with developer.

A developer replenishment shutter 44 is provided under the developer replenishment opening 43. Normally, the developer replenishment shutter 44 is closed. It is configured to be opened in the state in which the process cartridge P and the developer replenishment cartridge T are attached to the apparatus main body 100.

A replenishment conveyance member 41 and a replenishment agitation member 42 are provided inside the replenishment frame member 40. The replenishment conveyance member 41 and the replenishment agitation member 42 are rotatably supported by the replenishment frame member 40. The replenishment conveyance member 41 conveys the developer in the replenishment frame member 40 toward the developer replenishment opening 43.

As illustrated in FIG. 6, the replenishment conveyance member 41 is a screw member having a spiral fin 41*a* on the surface thereof. The fin 41*a* conveys the developer in the direction of the arrow Q. A cover member 47 is provided above the developer conveyance member 41. The cover member 47 covers the developer replenishment opening 43 and a portion in the longitudinal direction of the replenishment conveyance member 41. The cover member 47 is provided with a return hole 47*a*.

On the other hand, the replenishment agitation member 42 has two functions. One is to agitate the developer in the replenishment frame member 40. The other is to send the agitated developer to the replenishment conveyance member 41. The replenishment agitation member 42 is formed by a replenishment agitation bar 42*a* and a replenishment agitation sheet 42*b*.

A replenishment conveyance coupling 45 and a replenishment agitation coupling 46 are respectively provided at one end in the longitudinal direction of the replenishment conveyance member 41 and of the replenishment agitation member 42. The replenishment conveyance coupling 45 and the replenishment agitation coupling 46 are engaged with a coupling (not illustrated) of the apparatus main body 100.

The drive force of the drive motor (not illustrated) of the apparatus main body 100 is transmitted to the replenishment conveyance coupling 45 and the replenishment agitation coupling 46, whereby the replenishment conveyance member 41 and the replenishment agitation member 42 are rotated at a predetermined speed.

The conveyance of the developer in the developer replenishment cartridge T will be described. The developer in the replenishment frame member 40 is agitated by the replenishment agitation member 42, and is sent to the replenishment conveyance member 41. When conveyed to the cover member 47, the developer sent to the replenishment conveyance member 41 is partially regulated by the cover member 47. As a result, the amount of developer discharged from the developer replenishment opening 43 becomes constant.

The developer conveyed into the cover member 47 is discharged to the process cartridge P via the developer replenishment opening 43. The developer not having been dropped from the developer replenishment opening 43 is sent to the replenishment agitation member 42 from the return hole 47*a* to be agitated there again.

<Construction of the Developer Storage Portion>

Figure 7:
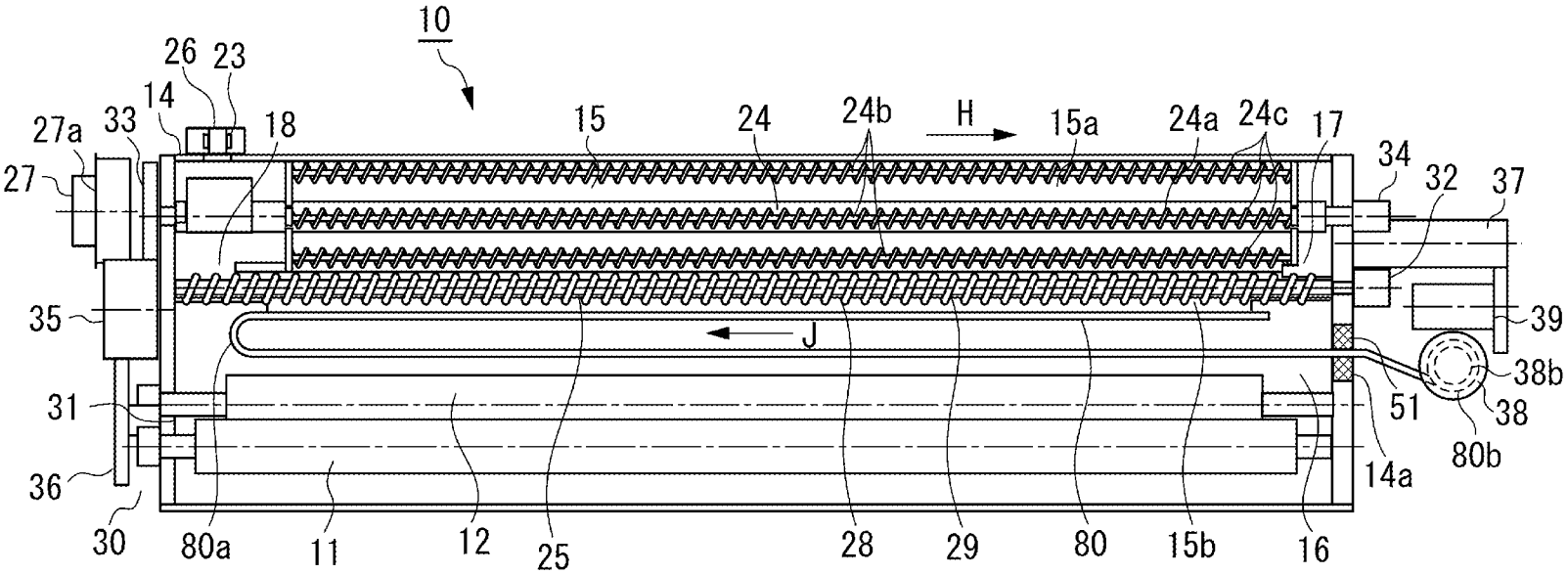
FIG. 7 is a schematic sectional view of a developing unit according to the first exemplary embodiment of the present invention.

Next, the construction of the developer storage portion 15 will be described with reference to FIG. 7. FIG. 7 is a schematic sectional view illustrating the construction of the developing unit.

As illustrated in FIG. 7, the developer storage portion 15 is divided into a first storage portion 15*a* and a second storage portion 15*b* by a partition portion 29. The first storage portion 15*a* and the second storage portion 15*b* are connected to each other via a first opening 17 and a second opening 18 provided at both ends in the longitudinal direction thereof.

The first storage portion 15*a* is provided with the developer reception port 23. The developer reception port 23 is connected with the developer replenishment opening 43 of the developer replenishment cartridge T. Through the connection between the developer replenishment opening 43 and the developer reception opening 23, developer is supplied from the developer replenishment cartridge T to the process cartridge P.

A developer reception shutter 26 is arranged on top of the developer reception port 23. Normally, the developer reception shutter 26 is closed. It is configured to be opened in the state in which the process cartridge P and the developer replenishment cartridge T are attached to the apparatus main body 100.

The second storage portion 15*b* is connected with the developing portion 16 via a development opening 28. When the process cartridge P is in the unused state, the development opening 28 is sealed with a sealing member 80. The sealing member 80 prevents leakage of developer from the developer storage portion 15 during physical distribution of the process cartridge P. The sealing member 80 is bonded to the surface of the development opening 28 by fusion bonding or the like.

As illustrated in FIG. 7, one end in the longitudinal direction of the sealing member 80 is folded back, and passes through a seal opening 14*a* provided in the developing frame member 14 to extend to the exterior of the developing frame member 14. The seal opening 14*a* is provided with a seal member 51. The seal member 51 prevents leakage of developer from the seal opening 14*a*.

An end portion 80*b* in the longitudinal direction of fold-back portion 80*a* of the sealing member 80 is connected with a take-up member 38 outside the developing frame member 14.

The sealing member 80 is bonded to a take-up shaft portion 38*b* by a double-faced tape or the like. When the process cartridge P is used, the sealing member 80 is removed by being taken up by the take-up member 38.

The first storage portion 15*a* is provided with a developer agitation member 24. The developer agitation member 24 has two functions. One is to mix the developer in the developer storage portion 15 with the developer supplied from the developer replenishment cartridge T. The other one is to convey the resultant developer mixture in the direction of the arrow H.

In the developer agitation member 24, an agitation spring 24*c* is mounted to a development support shaft 24*b* provided around the development agitation shaft 24*a*. The second storage portion 15*b* is provided with a developer conveyance member 25.

The developer conveyance member 25 is a screw member configured to convey the developer in the direction of the arrow J. At this time, the developer conveyance speed by the developer agitation member 24 is set to be lower than the developer conveyance speed by the developer conveyance member 25.

The conveyance of the developer within the developing unit 10 will be described. The developer supplied from the developer replenishment cartridge T is mixed with the developer in the developer storage portion 15 within the first storage portion 15*a* by the developer agitation member 24.

The resultant developer mixture is sent to the second storage portion 15*b* via the first opening 17. In the second storage portion 15*b*, the developer is conveyed to the developing portion 16 via the development opening 28 by the developer conveyance member 25.

The developer conveyed to the developing portion 16 is sent to the developing roller 11 via the supply roller 12 and is used for development. The portion of the developer that has not been used for development returns to the second storage portion 15*b* via the developing portion 16. Then, it is conveyed to the first storage portion 15*a* via the second opening 18 by the developer conveyance member 25. By repeating this, the developer is circulated.

<Drive Construction of the Developing Unit>

Next, the drive construction of the developing unit will be described with reference to FIGS. 5 and 7. FIG. 5 is an exploded overall perspective view of the process cartridge P. FIG. 7 is a schematic sectional view of the developing unit.

As illustrated in FIG. 7, a developing roller gear 30 for transmitting drive to the developing roller 11 is provided at one end of the developing roller 11. At one end of the supply roller 12, there is provided a supply roller gear 31 for transmitting drive to the supply roller 12. At one end of the developer conveyance member 25, there is provided a developer conveyance gear 32 for transmitting drive to the developer conveyance member 25.

At one end of the developer agitation member 24, there is provided a first developer agitation gear 33 (transmission member) configured to transmit the drive force for rotating the developer agitation member 24. At the other end of the developer agitation member 24, there is provided a second developer agitation gear 34 configured to transmit the drive force from the developer agitation member 24.

On the other hand, as illustrated in FIG. 5, at one end in the longitudinal direction of the developing unit 10, there is provided a developer drive coupling 27. The developer drive coupling 27 is configured to be engaged with a coupling (not illustrated) of the apparatus main body. The developer drive coupling 27 is configured to rotate at a predetermined speed when the drive force of a drive motor (not illustrated) of the apparatus main body 100 is transmitted thereto.

The drive force of the drive motor of the apparatus main body 100 is transmitted from the developer drive coupling 27 via the following route.

As illustrated in FIG. 7, the drive of the developer drive coupling 27 is transmitted to the developer roller gear 30 and the supply roller gear 31 from a gear portion 27*a* of the developer drive coupling 27 via a first idler gear 35 and a second idler gear 36. As a result, the developing roller 11 and the supply roller 12 are driven.

The drive of the first idler gear 35 is also transmitted to the first development agitation gear 33 to drive the developer agitation member 24. The drive of the developer agitation member 24 is transmitted from the second developer agitation gear 34 to the developer conveyance gear 32 via a third idler gear 37, whereby the developer conveyance member 25 is driven. The drive of the third idler gear 37 is also transmitted to a fourth idler gear 39.

The drive of the fourth idler gear 39 is transmitted to the take-up member 38 to rotate the take-up member 38. As a result, the sealing member 80 is taken up, and is removed from the development opening 28.

When the process cartridge P is attached to the apparatus main body 100 and is detected to be a new one, the developer drive coupling 27 is driven, whereby the taking-up of the sealing member 80 is started. When the sealing member 80 is removed from the development opening 28, the process cartridge P is made ready for use, and performs the above-described image forming operation.

<Method of Assembling (Manufacturing) the Developer Storage Portion>

A method of assembling (manufacturing) the developer agitation member 24 as the developer agitation member of the developer storage portion 15, and the first developer agitation gear 33 and the second developer agitation gear 34 as the support members, which constitute a feature of the present invention, will be described in detail with reference to FIGS. 1A and 1B and FIGS. 8 through 11.

Figure 1A:
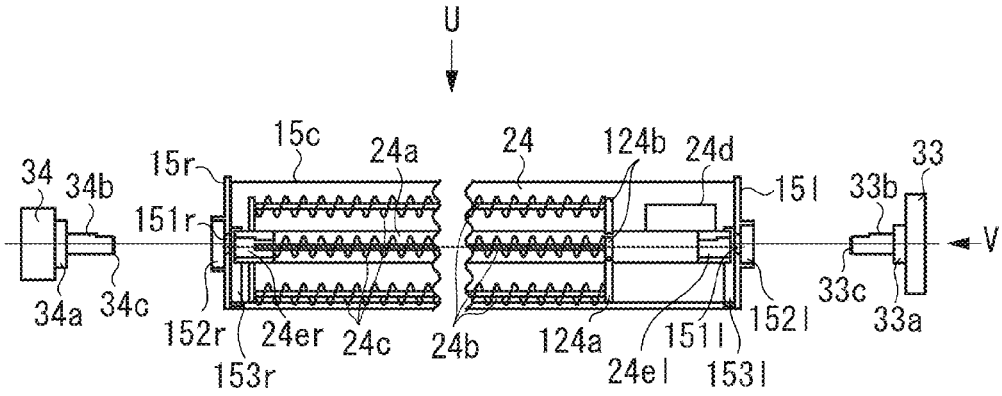
FIGS. 1A and 1B are schematic sectional views of a developer storage portion when a developer agitation member according to a first exemplary embodiment of the present invention is retained in a first phase and a second phase.
Figure 1B:
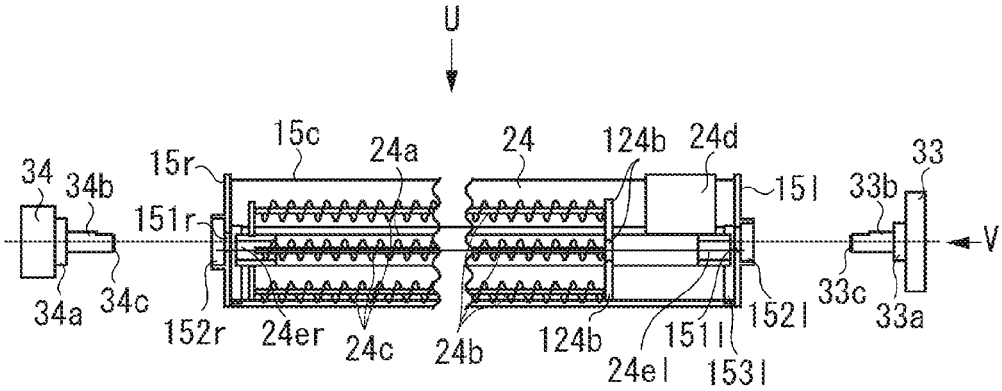

FIGS. 1A and 1B are schematic sectional views of the developer storage portion when the developer agitation member 24 is retained in a first phase and a second phase described below. FIG. 1A illustrates the state in which the developer agitation member is in the first phase, and FIG. 1B illustrates the state in which it is in the second phase.

Figure 8:
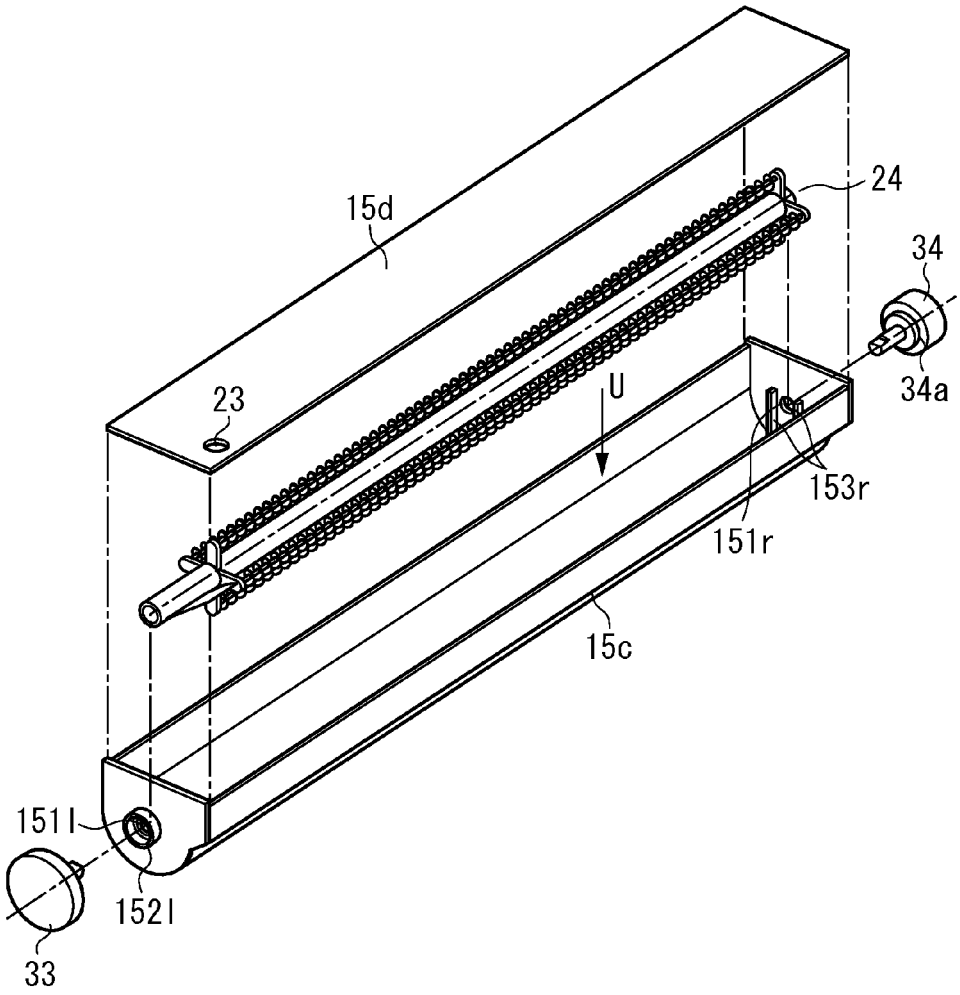
FIG. 8 is an exploded perspective view illustrating a method of assembling a developer agitation member, a first developer agitation gear, and a second developer agitation gear to the developer storage portion according to the first exemplary embodiment of the present invention.
Figure 9:
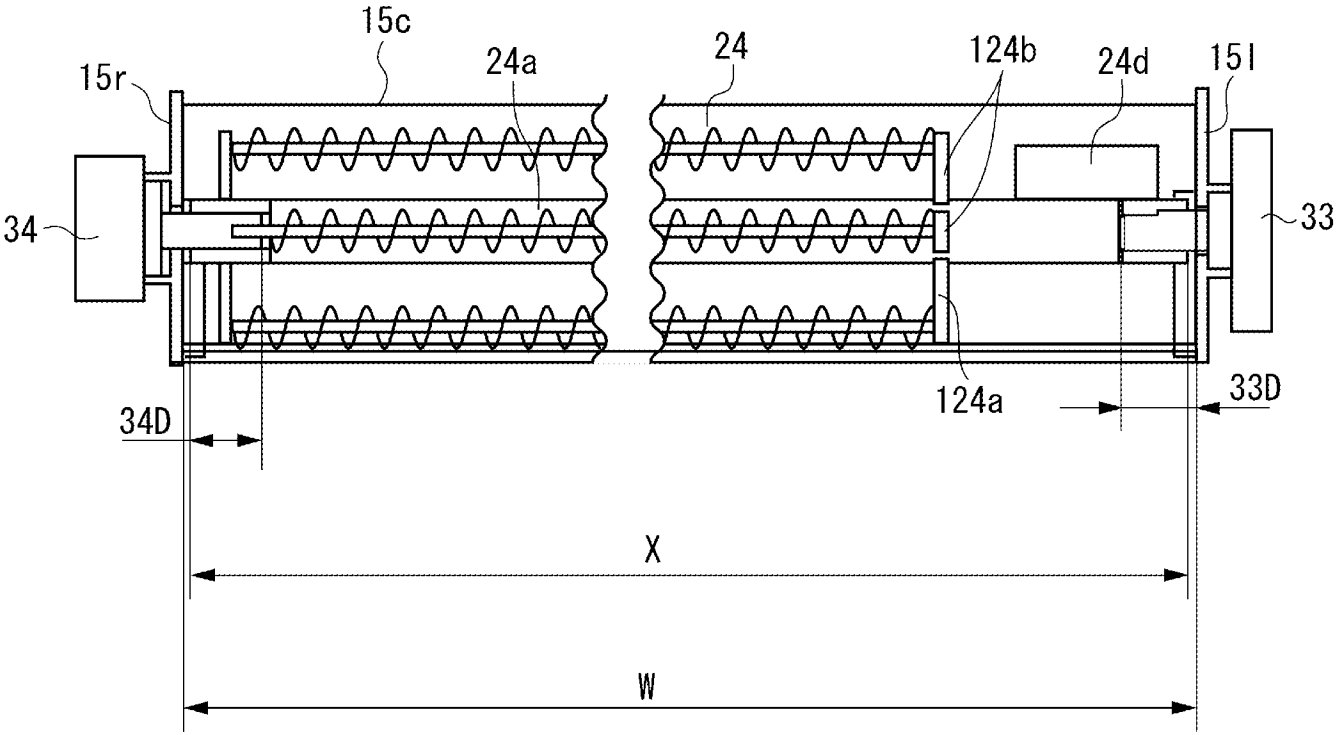
FIG. 9 is a schematic sectional view of a first storage portion of the developer storage portion according to the first exemplary embodiment of the present invention in the mounted state.

FIG. 8 is an exploded perspective view illustrating the method of assembling the developer agitation member 24, the first developer agitation gear 33, and the second developer agitation gear 34 with respect to the developer storage portion 15. FIG. 9 is a schematic sectional view illustrating a state in which a first storage portion 15*a* is mounted to the developer storage portion 15.

Figure 10A:
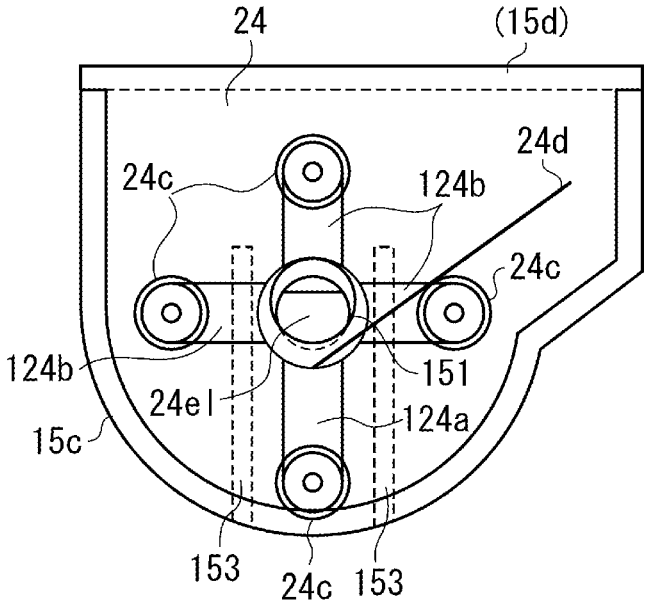
FIGS. 10A and 10B are diagrams, as seen in the direction of the arrow V in FIGS. 1A and 1B, illustrating the developer storage portion when the developer agitation member according to the first exemplary embodiment of the present invention is retained in a first phase and a second phase.
Figure 10B:
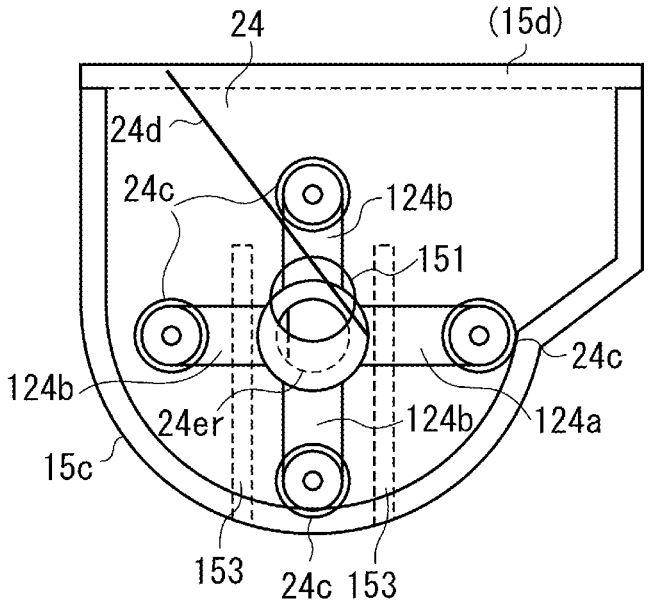
Figure 11:
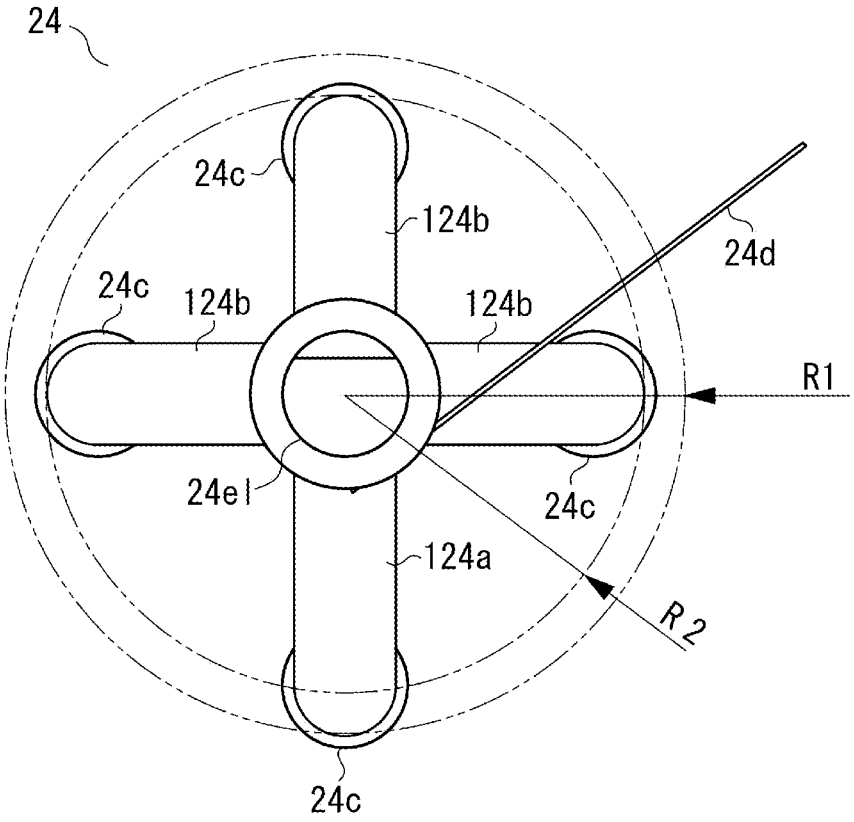
FIG. 11 is a diagram, as seen in the direction of the arrow V in FIGS. 1A and 1B, illustrating the developer agitation member according to the first exemplary embodiment of the present invention.

FIGS. 10A and 10B are diagrams, as seen in the direction of the arrow V in FIG. 1, illustrating the developer storage portion 15 with the developer agitation member 24 being retained in the first phase and in the second phase. FIG. 10A illustrates the state in which it is in the first phase, and FIG. 10B illustrates the state in which it is in the second phase. FIG. 11 is a diagram, as seen in the direction of the arrow V in FIG. 1, illustrating the developer agitation member 24.

As illustrated in FIG. 8, the first storage portion 15*a* of the developer storage portion 15 is assembled by inserting the developer agitation member 24, in the direction U, into a container portion 15*c* of the developer storage portion 15, and connecting the first developer agitation gear 33 and the second developer agitation gear 34 from both ends in the axial direction of the developer agitation member 24 respectively via through-holes 151*l* and 151*r*.

Then, a lid portion 15*d* is bonded to the container portion 15*c*, whereby the first storage portion 15*a* of the developer storage portion 15 is hermetically closed.

In the following, the construction of the developer storage portion 15 and the method of assembling the same according to the present exemplary embodiment will be described in detail.

In assembling the first storage portion 15*a* of the developer storage portion 15, the developer agitation member 24 is first inserted in the direction U into the container portion 15*c* of the developer storage portion 15. The container portion 15*c* of the developer storage portion 15 has side walls 15*l* and 15*r* at both ends in the axial direction of the developer agitation member 24, and the through-holes 151*l* and 151*r* are arranged at both side walls 15*l* and 15*r*.

Further, on the developer storage portion outer sides of the side walls 15*l* and 15*r*, there are provided fit-engagement portions 152*l* and 152*r* configured to be fit-engaged with a positioning portion 33*a* of the first developer agitation gear 33 and a positioning portion 34*a* of the second developer agitation gear 34, and to effect positioning on the first developer agitation gear 33 and the second developer agitation gear 34.

Here, as illustrated in FIG. 9, it is assumed that the length in the axial direction of the developer agitation member 24 is X, and that the distance between the side walls 15*l* and 15*r* of the container portion 15*c* is W, X<W. In other words, the developer agitation member 24 can be inserted straight in the direction U into the container portion 15*c*.

Here, as illustrated in FIG. 9, it is supposed that the respective amounts by which the first developer agitation gear 33 and the second developer agitation gear 34 protrude into the developer storage portion 15 in the mounted state, are 33D and 34D. In the present exemplary embodiment, the protrusion amounts 33D and 34D are larger than the gaps (W−X) between the two side walls 15*l* and 15*r* and the developer agitation member 24. That is, W−X<33D, and W−X<34D, so that it is impossible to mount the first developer agitation gear 33 and the second developer agitation gear 34 prior to the developer agitation member 24.

As illustrated in FIGS. 10A and 10B, the developer agitation member 24 is inserted to the position where an arm portion 124 corresponding to the outermost portion of the developer agitation member 24 and the bottom surface of the container portion 15*c* are brought into contact with each other. Here, as illustrated in FIG. 11, the arm portion 124 of the developer agitation member 24 has a first arm portion 124*a* (first contact portion) and a second arm portion 124*b*

(second contact portion), which differ in the distance from the rotation shaft to the distal end thereof (i.e., the arm portion length).

Assuming that the respective distances from the rotation shaft to the distal end are R1 and R2, R1>R2 is satisfied. Therefore, there is generated a difference in positional deviation amount between the through-holes 151*l* and 151*r* and the developer agitation shaft 24*a* when the developer agitation member 24 is placed inside the container portion 15*c*. When the first arm portion 124*a* is supported by the container bottom surface, the distance between the developer agitation shaft 24*a* of the developer agitation member 24 and the through-holes 151*l* and 151*r* is minimum.

Here, the rotational direction phase of the developer agitation member 24 in the state in which the first arm portion 124*a* is supported will be referred to as the first phase, and the rotational direction phase of the developer agitation member 24 in the state in which the second arm portion 124*b* is supported will be referred to as the second phase.

When the developer agitation member 24 is inserted into the container portion 15*c*, the position of the developer agitation member 24 in the first phase is as illustrated in FIGS. 1A and 10A. On the other hand, the position of the developer agitation member 24 in the second phase is as illustrated in FIGS. 1B and 10B.

Further, as illustrated in FIGS. 8, 10A, and 10B, there are provided, on the developer storage portion side of the side walls 15*l* and 15*r*, there are provided guide portions 153*l* and 153*r* configured to guide the developer agitation shaft 24*a* and to prevent falling thereof.

In other words, the guide portions 153*l* and 153*r* (support portions) support the developer agitation member 24 so as to maintain the attitude of the developer agitation member 24 placed inside the container portion 15*c* without being connected with the first developer agitation gear 33 and the second developer agitation gear 34. This makes it possible to stabilize the attitude of the developer agitation member 24, making it possible to temporarily retain the developer agitation member 24 in the container portion 15*c* in a stable manner.

Here, in the attached state, engagement holes 24*el* and 24*er* provided at both ends in the axial direction of the developer agitation member 24 are engaged with engagement portions 33*b* and 34*b* of the first developer agitation gear 33 and the second developer agitation gear 34, whereby positioning is effected.

The engagement portions 33*b* and 34*b* and the engagement holes 24*el* and 24*er* are in a so-called D-cut-shaped relationship, and the first developer agitation gear 33, the second developer agitation gear 34, and the developer agitation member 24 can be connected solely in a predetermined phase relationship in the rotational direction of the developer agitation member 24.

Further, the engagement portions 33*b* and 34*b* of the first developer agitation gear 33 and the second developer agitation gear 34 enter the container portion 15*c* while being regulated by the through-holes 151*l* and 151*r* in the insertion paths of the respective gears.

In the present exemplary embodiment, when the developer agitation member 24 is in the first phase, the first developer agitation gear 33 and the second developer agitation gear 34 are received due to beveled portions 33*c* and 34*c* provided at their respective distal ends, and are connected with the developer agitation member 24.

However, when the developer agitation member 24 is in the second phase, the distance between the developer agitation shaft 24*a* and the through-holes 151*l* and 151*r* becomes larger than that when the developer agitation member 24 is in the first phase.

Thus, when the developer agitation member 24 is in the second phase, the engagement portions 33*b* and 34*b* of the first developer agitation gear 33 and the second developer agitation gear 34 cannot be inserted into the engagement holes 24*el* and 24*er* of the developer agitation member 24 in their insertion paths, and cannot be connected therewith.

In this way, there is provided the first arm portion 124*a* configured to abut the container portion 15*c* when the developer agitation member 24 in the state in which it is not connected with the developer agitation gears 33 and 34 is placed in the container portion 15*c* in the first phase, and, when the first arm portion 124*a* is held in contact with the container portion 15*c*, the developer agitation member 24 and the developer agitation gears 33 and 34 can be connected via the through-holes 151*l* and 151*r*.

Further, there is provided the second arm portion 124*b* configured to abut the container portion 15*c* when the developer agitation member 24 in the state in which it is not connected with the developer agitation gears 33 and 34 is placed in the container portion 15*c* in the second phase, and when the second arm portion 124*b* is held in contact with the container portion 15*c*, the developer agitation member 24 and the developer agitation gears 33 and 34 cannot be connected via the through-holes 151*l* and 151*r*.

In other words, solely in the state in which the developer agitation member 24 is placed in the container portion 15*c* in the first phase, the first developer agitation gear 33 and the second developer agitation gear 34 can be connected. Further, the phase when the developer agitation member 24 is connected with respect to the first developer agitation gear 33 and the second developer agitation gear 34 is fixed, so that it is possible to fix the phase when each gear is inserted.

In other words, by retaining the developer agitation member 24 inside the container portion 15*c* in the first phase, the phase at the time of insertion of the first developer agitation gear 33 and the second developer agitation gear 34 is determined, whereby it is possible to achieve an improvement in terms of workability at the time of assembly.

In the present exemplary embodiment, the developer agitation member 24 is inserted into the container portion 15*c* and placed therein in the first phase (first step).

Next, the first developer agitation gear 33 and the second developer agitation gear 34 are inserted via the through-holes 151*l* and 151*r* to engage the engagement portions 33*b* and 34*b* of the first developer agitation gear 33 and the second developer agitation gear 34 with the engagement holes 24*el* and 24*er* of the developer agitation member 24, whereby the first developer agitation gear 33 and the second developer agitation gear 34 are connected with the developer agitation member 24 (the second step). At this time, the positioning portions 33*a* and 34*a* of the first developer agitation gear 33 and the second developer agitation gear 34 are fit-engaged with the fit-engagement portions 151*l* and 151*r* of the side walls 15*l* and 15*r*.

Further, as illustrated in FIGS. 1A, 1B, 10A, and 10B, in the present exemplary embodiment, a sheet member 24*d* is arranged on the developer agitation member 24. This sheet member 24*d* exhibits flexibility. It is provided under the developer reception port 23, and serves to scrape off the developer supplied from the developer reception port 23 to thereby prevent the developer from staying.

If left to stay for a long time in a deflected state, such a sheet member with flexibility may become incapable of exerting its function in a satisfactory manner due to plastic deformation.

Thus, in the developer storage container using such a sheet member, it is necessary to position the developer agitation member in a phase which will impart no stress to the sheet member after the assembly.

Here, as illustrated in FIGS. 10A and 10B, when the developer agitation member 24 is connected with the first developer agitation gear 33 and the second developer agitation gear 34 in the first phase, the sheet member 24*d* is at a position where it is not in contact with the container portion 15*c* and the lid portion 15*d*.

In other words, at the time of connection, the sheet member 24*d* is situated at a position where it is not deformed by a component member of the developer storage portion. As a result, simultaneously with the mounting of the first developer agitation gear 33 and the second developer agitation gear 34 to the developer agitation member 24, the phase of the sheet member 24*d* is fixed at an optimum position, and there is no need to perform phase matching after the assembly.

As described above, according to the present exemplary embodiment, when the developer agitation member 24 is mounted to the container portion 15*c*, the first arm portion 124*a* of the developer agitation member 24 is supported by the container portion 15*c*, whereby there is no need to perform the retaining process for retaining the developer agitation member 24 in a raised state by a worker of the developer agitation member 24 or by a device.

Further, the phase allowing the mounting of the first developer agitation gear 33 and the second developer agitation gear 34 of the developer agitation member 24 is restricted, so that the phase of the developer agitation member 24 is determined simultaneously with the mounting of the first developer agitation gear 33 and the second developer agitation gear 34.

Further, there is no need to provide a construction for temporarily retaining the developer agitation shaft 24*a* in a raised state at the time of mounting the developer agitation member 24 into the container portion 15*c*, so that an increase in the volume of the developer storage portion is to be expected. Thus, it is possible to achieve an improvement in terms of workability when the developer agitation member is mounted to the developer storage portion without affecting the developer volume.

In the above-described first exemplary embodiment, the external form of the developer agitation member 24 is determined by the arm portions 124*a* and 124*b*, and the distances between their outermost portions and the rotation center are uniformly R1 and R2 substantially over the entire region in the axial direction.

In a second exemplary embodiment of the present invention described below with reference to FIGS. 12 through 14, there is, at a part in the axial direction of a developer agitation member 224, a portion where the distance in the radial direction from the outermost portion is substantially constant in the circumferential direction.

The construction of the developer storage portion 15 and the method of assembling the developer agitation member 224 are the same as those of the first exemplary embodiment, so that the components that are the same as those of the first exemplary embodiment are designated by the same reference numerals, and a description thereof will be omitted.

Figure 12:
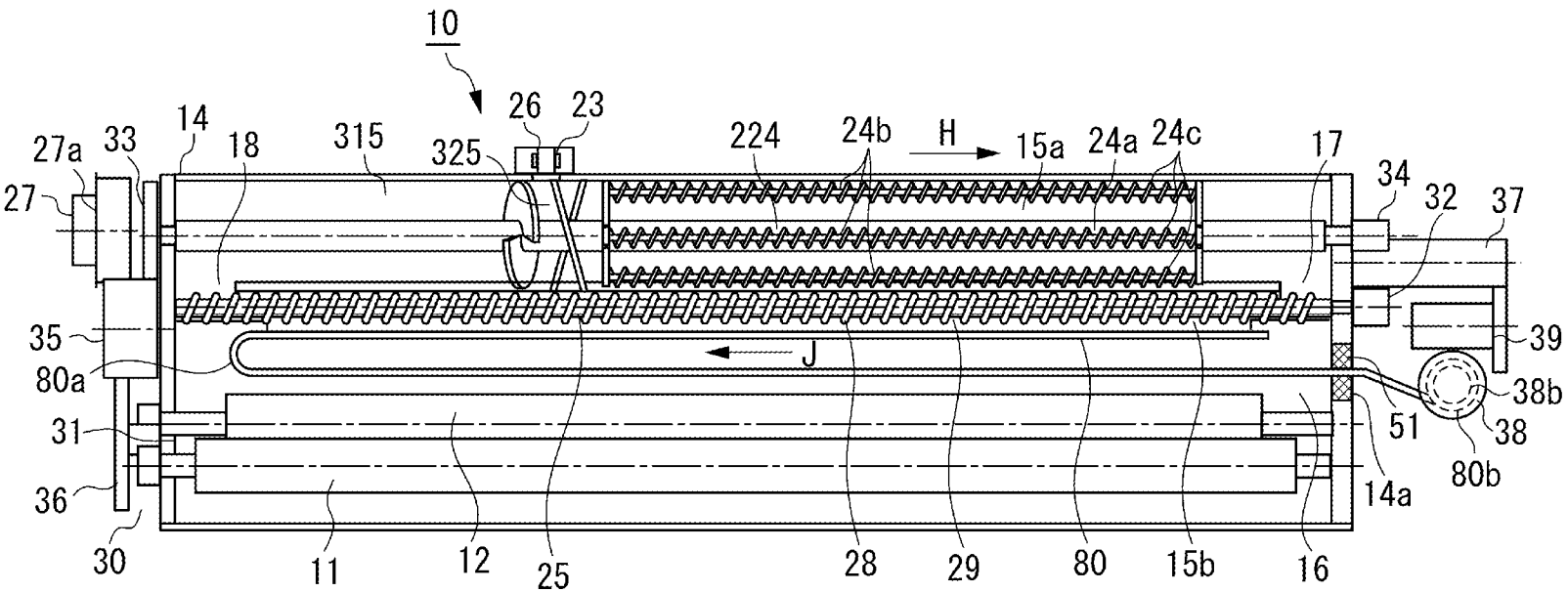
FIG. 12 is a schematic sectional view of a developing unit according to the second exemplary embodiment of the present invention.
Figure 13A:
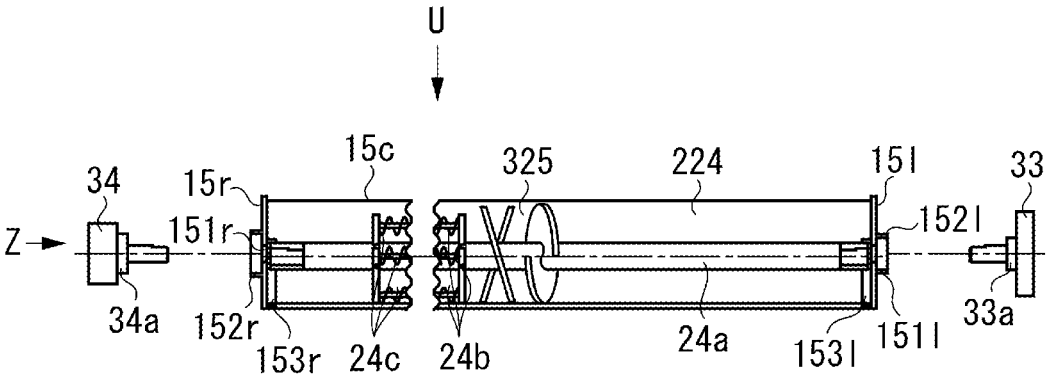
FIGS. 13A and 13B are schematic sectional views illustrating the developer storage portion when the developer agitation member according to the second exemplary embodiment of the present invention is retained in a first phase and a second phase.
Figure 13B:
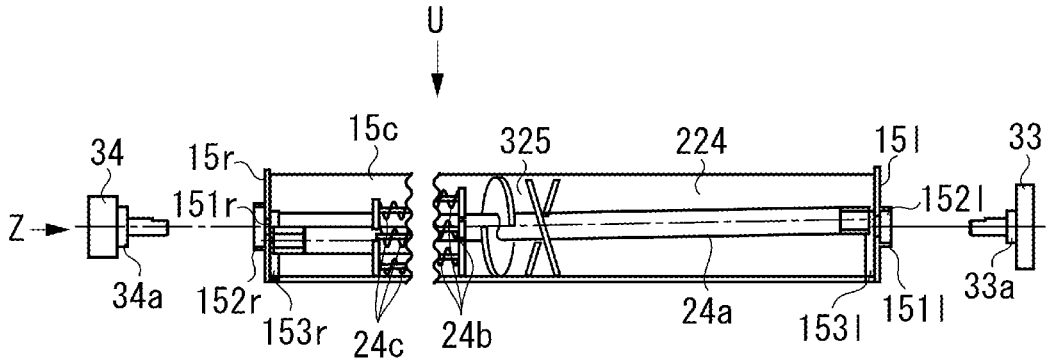

FIG. 12 is a schematic sectional view of the developing unit according to the present exemplary embodiment. FIGS. 13A and 13B are schematic sectional views of the developer storage portion 15 when the developer agitation member 224 is retained in the first phase and in the second phase, respectively. FIG. 14 is a diagram, as seen from the direction of the arrow Z in FIGS. 13A and 13B, of the developer agitation member 224.

As illustrated in FIG. 12, in the present exemplary embodiment, there is arranged an agitation rib 325 crossing the portion immediately below the developer reception port 23 of the developer agitation member 224. As illustrated in FIG. 14, this agitation rib 325 extends over the entire circumferential area in an outer diameter R3 which is substantially equal to R1.

This agitation rib 325 serves to prevent the developer from staying by scattering the developer supplied from the developer reception port 23 in the axial direction of the developer agitation member 224.

As in the first exemplary embodiment, the method of assembling the first storage portion 15*a* of the developer storage portion 315 is started with the insertion of the developer agitation member 224 into the container portion 15*c*.

Figure 14:
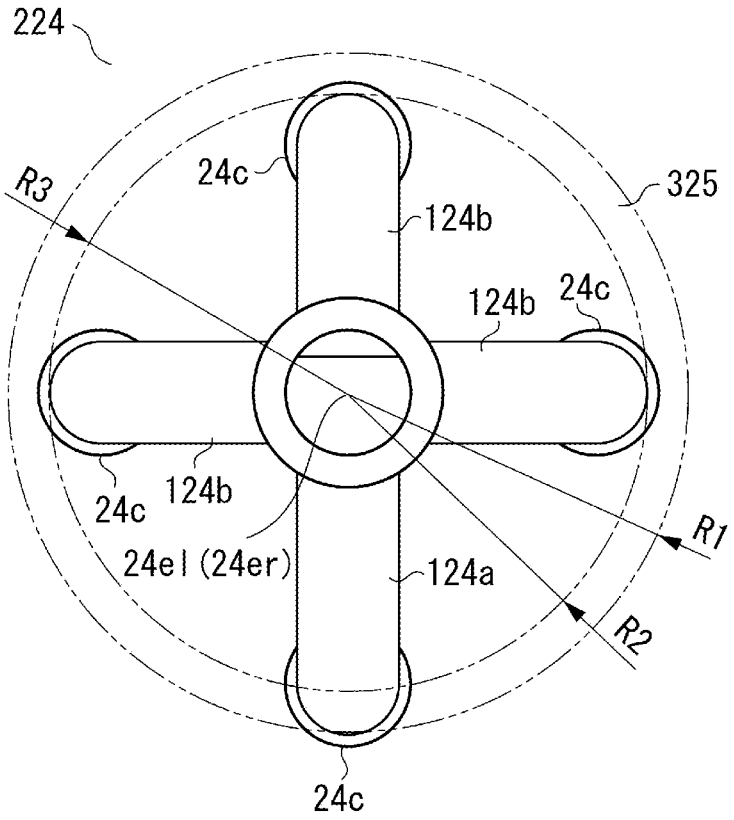
FIG. 14 is a diagram, as seen in the direction of the arrow Z in FIGS. 13A and 13B, illustrating the developer agitation member according to the second exemplary embodiment of the present invention.

However, as illustrated in FIG. 14, in the present exemplary embodiment, there is arranged the agitation rib 325 whose radius R3 as measured from the rotation shaft extends substantially uniformly in the circumferential direction. Thus, it is impossible to shift the positions of the through-holes 151*l* and 151*r* and of the developer agitation shaft 24*a* uniformly in the axial direction as in the first exemplary embodiment described above.

Therefore, in the present exemplary embodiment, the radius R3 of the agitation rib 325 as measured from the rotation shaft is made substantially equal to the radius R1 of the first arm portion 124*a*. Further, the developer reception port 23 is shifted from the position of the center of gravity of the developer agitation member 224, whereby the position in the axial direction of the agitation rib 325 is situated far from the position of the center of gravity of the developer agitation member 224.

In other words, as illustrated in FIG. 13A, the attitude of the developer agitation member 224 in the first phase is substantially parallel to the bottom surface of the container portion 15*c*. On the other hand, as illustrated in FIG. 13B, the attitude of the developer agitation member 224 in the second phase is inclined since the relationship between the radius R3 as measured from the rotation shaft of the agitation rib 325 and the radius R2 of the second arm portion 124*b* is set as R3>R2.

This is due to the fact that the position in the axial direction of the agitation rib 325 is deviated from the position of the center of gravity of the developer agitation member 224. As a result, the first developer agitation gear 33 and the second developer agitation gear 34 can only be connected in the first phase.

As described above, according to the present exemplary embodiment, at the time of mounting the developer agitation member 224 to the container portion 15*c*, retention is effected by the container portion 15*c*, the arm portion 24 of the developer agitation member 224, and the agitation rib 325, so that there is no need for the developer agitation member 224 to be retained by a worker or by a device.

Further, even in the case where there is, at a part in the axial direction of the developer agitation member 224, a portion where the distance in the radial direction of the outermost portion is substantially constant in the circumferential direction, it is possible to restrict the phase allowing mounting of the first developer agitation gear 33 and the second developer agitation gear 34 due to the relationship between the agitation rib 325, the first arm portion 124*a*, and the second arm portion 124*b*.

Further, at the time of mounting of the developer agitation member 224 into the container portion 15*c*, there is no need to provide a construction for temporarily retaining the developer agitation shaft 24*a*, so that an increase in the volume of the developer storage portion is to be expected. Accordingly, it is possible to achieve an improvement in terms of workability when the developer agitation member is mounted into the developer storage portion without having to sacrifice the developer volume.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-159515, filed July 18, which is hereby incorporated by reference herein in its entirety.

What is claimed is:

1. A developer storage container comprising:

a container portion configured to store developer;

an agitation member provided inside the container portion and configured to agitate the developer through rotation, the agitation member including a rotation shaft and first and second contact portions, each having a length extending radially from the rotation shaft; and a transmission member connected to the agitation member via a through-hole provided in the container portion and configured to transmit a drive force for rotation to the agitation member, wherein the length of the first contact portion is longer than the length of the second contact portion such that:

the first contact portion is configured to be held in contact with the container portion when the agitation member, not connected with the transmission member, is placed inside the container portion in a first phase in a rotational direction of the agitation member, and allow connection between the agitation member and the transmission member via the through-hole when the first contact portion is held in contact with the container portion, and the second contact portion is configured to be held in contact with the container portion when the agitation member, not connected with the transmission member, is placed inside the container portion in a second phase in the rotational direction of the agitation member, and not allow connection between the agitation member and the transmission member via the through-hole when the second contact portion is held in contact with the container portion.

2. The developer storage container according to claim 1, wherein the agitation member and the transmission member can be connected in a predetermined phase relationship thereof in the rotational direction of the agitation member.

3. The developer storage container according to claim 1, wherein, when the agitation member not connected with the transmission member is placed in the container portion in the first phase in the rotational direction of the agitation member, the first contact portion comes into contact with a bottom surface of the container.

4. The developer storage container according to claim 1, wherein the agitation member has a flexible sheet member configured to agitate the developer through rotation, and wherein the sheet member is situated at a position where it is not deformed by a component member of the developer storage container when the agitation member is connected with the transmission member in the first phase in the rotational direction of the agitation member.

5. The developer storage container according to claim 1, further comprising a support member configured to support the agitation member so as to maintain the attitude of the agitation member placed in the container portion while not connected with the transmission member.

6. A developing apparatus comprising:

the developer storage container according to claim 1; and a developer bearing member configured to bear developer to develop an electrostatic latent image.

7. A process cartridge detachably attachable to an image forming apparatus main body, comprising:

the developing apparatus according to claim 6; and an image bearing member configured to bear the electrostatic latent image.

8. A process cartridge detachably attachable to an image forming apparatus main body, comprising:

the developer storage container according to claim 1; and an image bearing member configured to bear an electrostatic latent image to be developed with developer stored in the developer storage container.

9. An image forming apparatus configured to form an image by using the developer storage container according to claim 1, and developer stored in the developer storage container.

10. The developer storage container according to claim 1, wherein the container portion includes a support member configured to prevent the agitation member from falling when the agitation member is placed in the container portion.

11. A method of manufacturing a developer storage container including a container portion configured to store developer, an agitation member provided inside the container portion and configured to agitate the developer through rotation, the agitation member including a rotation shaft and first and second contact portions, each having a length extending radially from the rotation shaft, and a transmission member connected to the agitation member via a through-hole provided in the container portion and configured to transmit a drive force for rotation to the agitation member, wherein the length of the first contact portion is longer than the length of the second contact portion such that the first contact portion is configured to be held in contact with the container portion when the agitation member not connected with the transmission member is placed inside the container portion in a first phase in a rotational direction of the agitation member, and allow connection between the agitation member and the transmission member via the through-hole when the first contact portion is held in contact with the container portion, and the second contact portion is configured to be held in contact with the container portion when the agitation member not connected with the transmission member is placed inside the container portion in a second phase in the rotational direction of the agitation member, and not allow connection between the agitation member and the transmission member via the through-hole when the second contact portion is held in contact with the container portion, the method comprising:

placing the agitation member not connected with the transmission member inside the container portion in the first phase in the rotational direction of the agitation member; and connecting the agitation member and the transmission member via the through-hole when the first contact portion is held in contact with the container portion.

12. A developer storage container comprising:

a container portion configured to store developer;

an agitation member provided inside the container portion and configured to agitate the developer through rotation; and a transmission member connected to the agitation member via a through-hole provided in the container portion and configured to transmit a drive force for rotation to the agitation member, wherein the agitation member has a first contact portion configured to be held in contact with the container portion when the agitation member, not connected with the transmission member, is placed inside the container portion in a first phase in a rotational direction of the agitation member, and allow connection between the agitation member and the transmission member via the through-hole when the first contact portion is held in contact with the container portion, wherein the agitation member has a second contact portion configured to be held in contact with the container portion when the agitation member, not connected with the transmission member, is placed inside the container portion in a second phase in the rotational direction of the agitation member, and not allow connection between the agitation member and the transmission member via the through-hole when the second contact portion is held in contact with the container portion, and wherein, when the agitation member, not connected with the transmission member, is placed in the container portion in the first phase in the rotational direction of the agitation member, the first contact portion comes into contact with a bottom surface of the container.

13. The developer storage container according to claim 12, wherein the agitation member includes:

a first arm having the first contact portion; and a second arm having the second contact portion.

14. The developer storage container according to claim 13, wherein a length of the first arm is longer than a length of the second arm.

15. The developer storage container according to claim 12, wherein the container portion includes a support member configured to prevent the agitation member from falling when the agitation member is placed in the container portion.

16. A developer storage container comprising:

a container portion configured to store developer;

an agitation member provided inside the container portion and configured to agitate the developer through rotation; and a transmission member connected to the agitation member via a through-hole provided in the container portion and configured to transmit a drive force for rotation to the agitation member, wherein the agitation member has a first contact portion which allows connection between the agitation member and the transmission member via the through-hole when the first contact portion is held in contact with a bottom of the container portion, and wherein the agitation member has a second contact portion which does not allow connection between the agitation member and the transmission member via the through-hole when the second contact portion is held in contact with a bottom of the container portion.

17. The developer storage container according to claim 16, wherein the agitation member includes:

a first arm having the first contact portion; and a second arm having the second contact portion.

18. The developer storage container according to claim 17, wherein a length of the first arm is longer than a length of the second arm.

19. The developer storage container according to claim 16, wherein the container portion includes a support member configured to prevent the agitation member from falling when the agitation member is placed in the container portion.

* * * * *